US007204718B2

(12) United States Patent
Lai

(10) Patent No.: US 7,204,718 B2
(45) Date of Patent: Apr. 17, 2007

(54) SHORT-CIRCUIT-PROOF CARD CONNECTOR

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/287,373

(22) Filed: Nov. 28, 2005

(65) Prior Publication Data

US 2007/0054560 A1 Mar. 8, 2007

(30) Foreign Application Priority Data

Sep. 2, 2005 (TW) ..... 94215163 U

(51) Int. Cl.
*H01R 24/00* (2006.01)

(52) U.S. Cl. ..... 439/630; 439/924.1

(58) Field of Classification Search ..... 439/64, 439/101, 108, 377, 630, 631, 924.1
See application file for complete search history.

(56) References Cited

U.S. PATENT DOCUMENTS 6,056,573 A * 5/2000 Nishioka ..... 439/326
6,386,920 B1 * 5/2002 Sun ..... 439/630
6,402,529 B2 * 6/2002 Saito et al. ..... 439/74
6,669,487 B1 * 12/2003 Nishizawa et al. ..... 439/60
6,926,559 B1 * 8/2005 Hung et al. ..... 439/630

* cited by examiner

*Primary Examiner*—Thanh-Tam Le
(74) *Attorney, Agent, or Firm*—Bacon & Thomas, PLLC

(57) ABSTRACT

A short-circuit-proof card connector is composed of a shell and at least two (first and second) terminal groups. The shell includes an opening, at least two receiving spaces for receiving a first card and a second card respectively, two first guiding faces formed at bilateral sides of the first receiving space, and two second guiding faces formed at bilateral sides of the second receiving space. The second terminal group close to the opening has a power terminal and a grounded terminal. A first interval is defined between the first and second guiding faces close to the power terminal. A second interval is defined between the first and second guiding faces close to the grounded terminal. The first interval is smaller than the second interval such that an electrically conductive surface of the first card does not touch the power terminal to avoid short circuit while the first card is inserted.

3 Claims, 10 Drawing Sheets

SHORT-CIRCUIT-PROOF CARD CONNECTOR

BACKGROUND OF THE INVENTION

1. Field of the Invention

The present invention relates generally to connectors of electronic apparatuses for electronic memory cards, and more particularly, to a short-circuit-proof card connector.

2. Description of the Related Art

Most of the current card connectors are structurally all-in-one to each have a receiving space formed in a shell thereof for receiving various kinds of the cards, and corresponding terminals for electronic connection with the cards.

Referring to FIGS. 9 and 10, a conventional all-in-one card connector 70 includes a shell 71 having a space for receiving various kinds of the cards. The space is formed of a first subspace and a second subspace for receiving a memory stick (MS) card or memory stick DUO (MS-DUO) adaptor 78 and an extreme digital (XD) card (not shown) respectively. The shell 71 further includes a first terminal group 72 and a second terminal group 73 for electronic connection with the MS-DUO adaptor and the XD card respectively.

The aforementioned all-in-one card connector 70, while receiving the MS-DUO adaptor 78, is subject to short circuit because of the following reason. The MS-DUO adaptor 78 has metallic parts covering its top side, two sides, and partial bilateral sides of its bottom side. As shown in FIG. 10, because an interval A defined between bilateral terminals of the second terminal group 73 is larger than an interval B defined between bilateral metal parts 79 of a bottom side of the MS-DUO adaptor 78, while the MS-DUO adaptor 78 is being inserted into the card connector 70, the bilateral metallic parts 79 of the bottom side right touches the bilateral terminals of the second terminal group 73, both of which are power terminals 731 and grounded terminals 732, thus incurring a short circuit and causing potential burnout of electronic circuits or other external electronic apparatuses.

SUMMARY OF THE INVENTION

The primary objective of the present invention is to provide a short-circuit-proof card connector, which avoids short circuit incurred by its terminals touching corresponding terminals of an electronic card or an adaptor while the electronic card or the adaptor is inserted into the card connector.

The foregoing objective of the present invention is attained by the short-circuit-proof card connector, which is composed of a shell and at least two terminal groups. The shell includes an opening, at least two receiving spaces, two first guiding faces, and two second guiding faces. The opening is formed at a front end of the shell. The at least two receiving spaces, two of which are defined as a first receiving space and a second receiving space for receiving a thick and narrow first card and a thin and wide second card respectively, extend inwards from the opening and partially overlap each other. The two first guiding faces are formed at bilateral sides of the first receiving space. The two second guiding faces are formed at bilateral sides of the second receiving space. The at least two terminal groups, two of which are defined as a first terminal group and a second terminal group, each are formed of a plurality of terminals and mounted in the shell. The first terminal group is located farther from the opening for electronic connection with the first card. The second terminal group is located closer to the opening for electronic connection with the second card. There is a power terminal and a grounded terminal in the second terminal group. A first interval is defined between the first and second guiding faces located close to the power terminal. A second interval is defined between the first and second guiding faces located close to the grounded terminal. The first interval is smaller than the second interval such that an electrically conductive surface of the first card does not touch the power terminal to avoid short circuit while the first card is inserted.

DETAILED DESCRIPTION OF PREFERRED EMBODIMENTS

Figure 1:
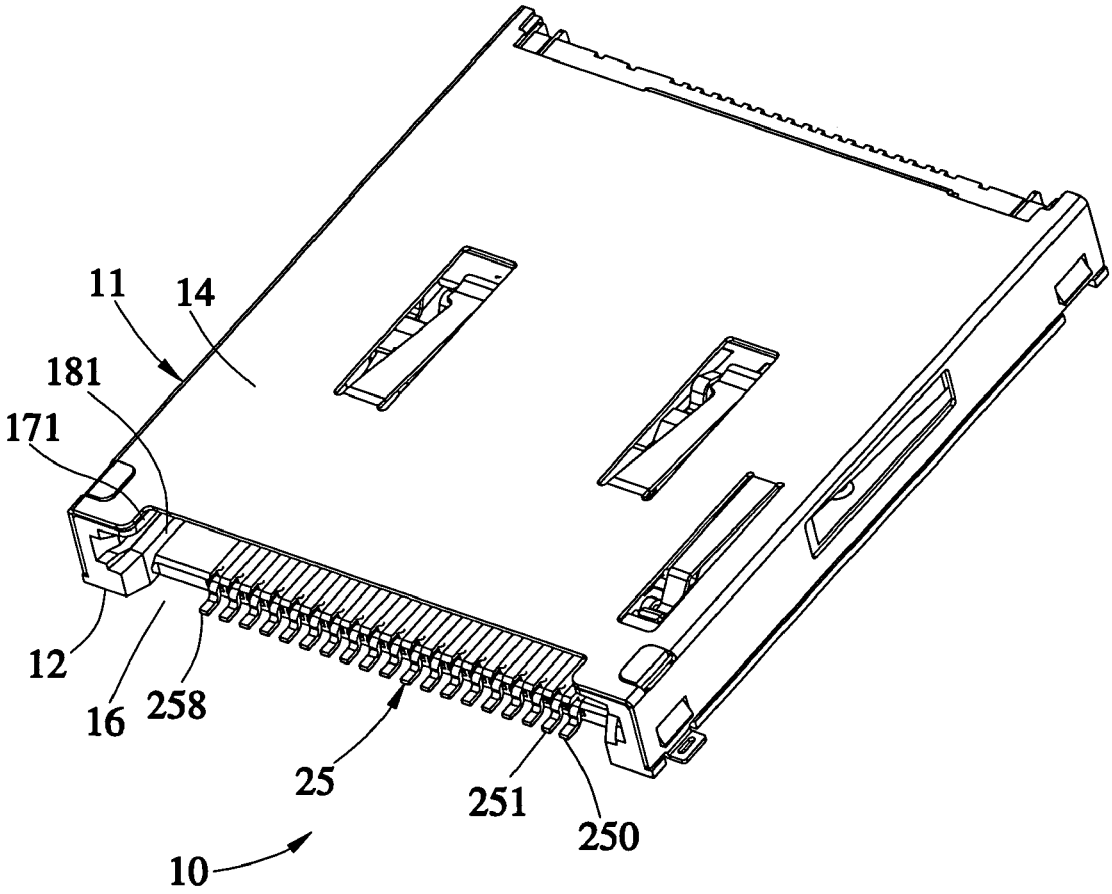
FIG. 1 is a perspective view of a preferred embodiment of the present invention.
Figure 2:
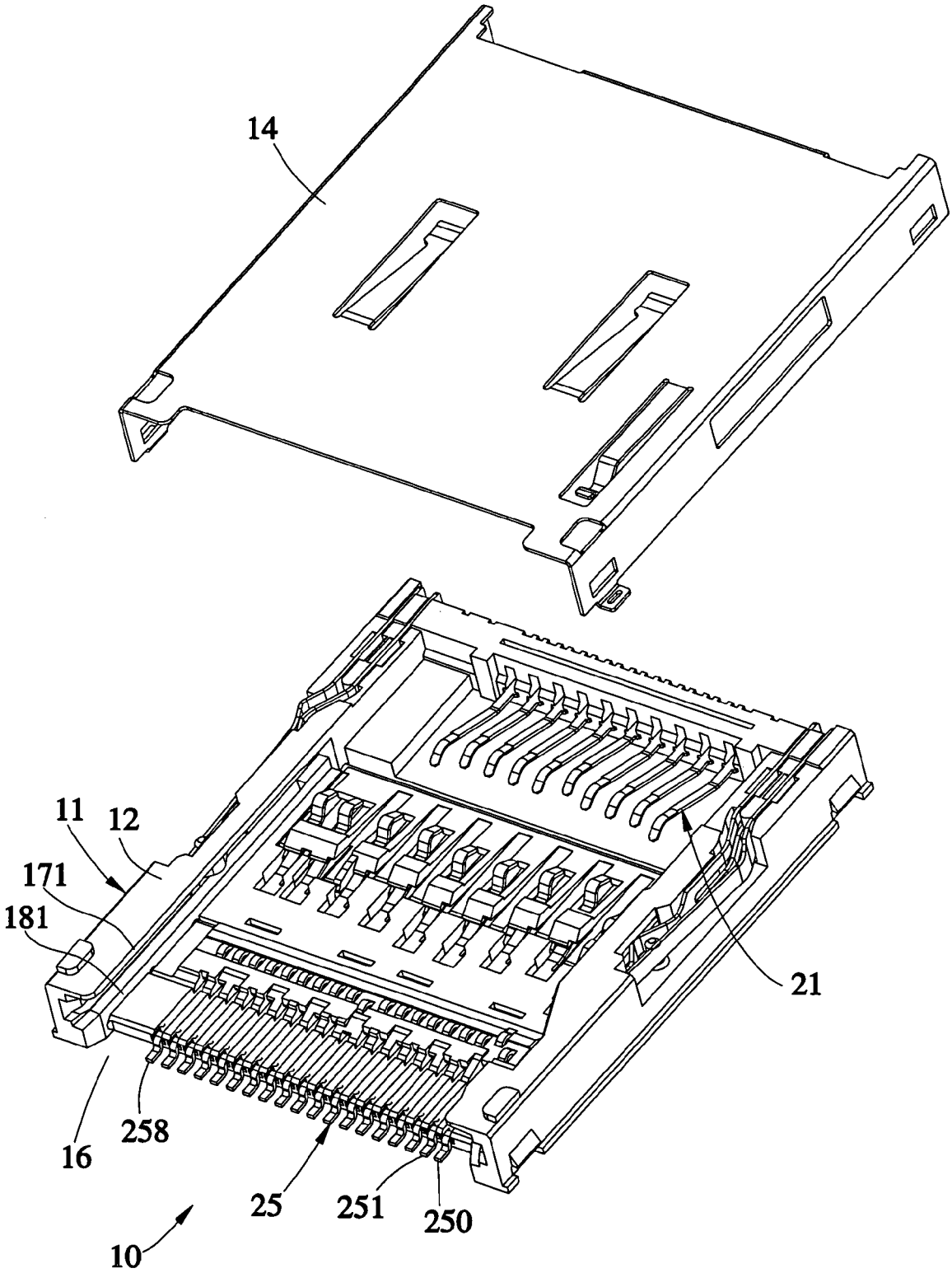
FIG. 2 is an exploded view of the preferred embodiment of the present invention, showing that a cover and a base are separated.
Figure 3:
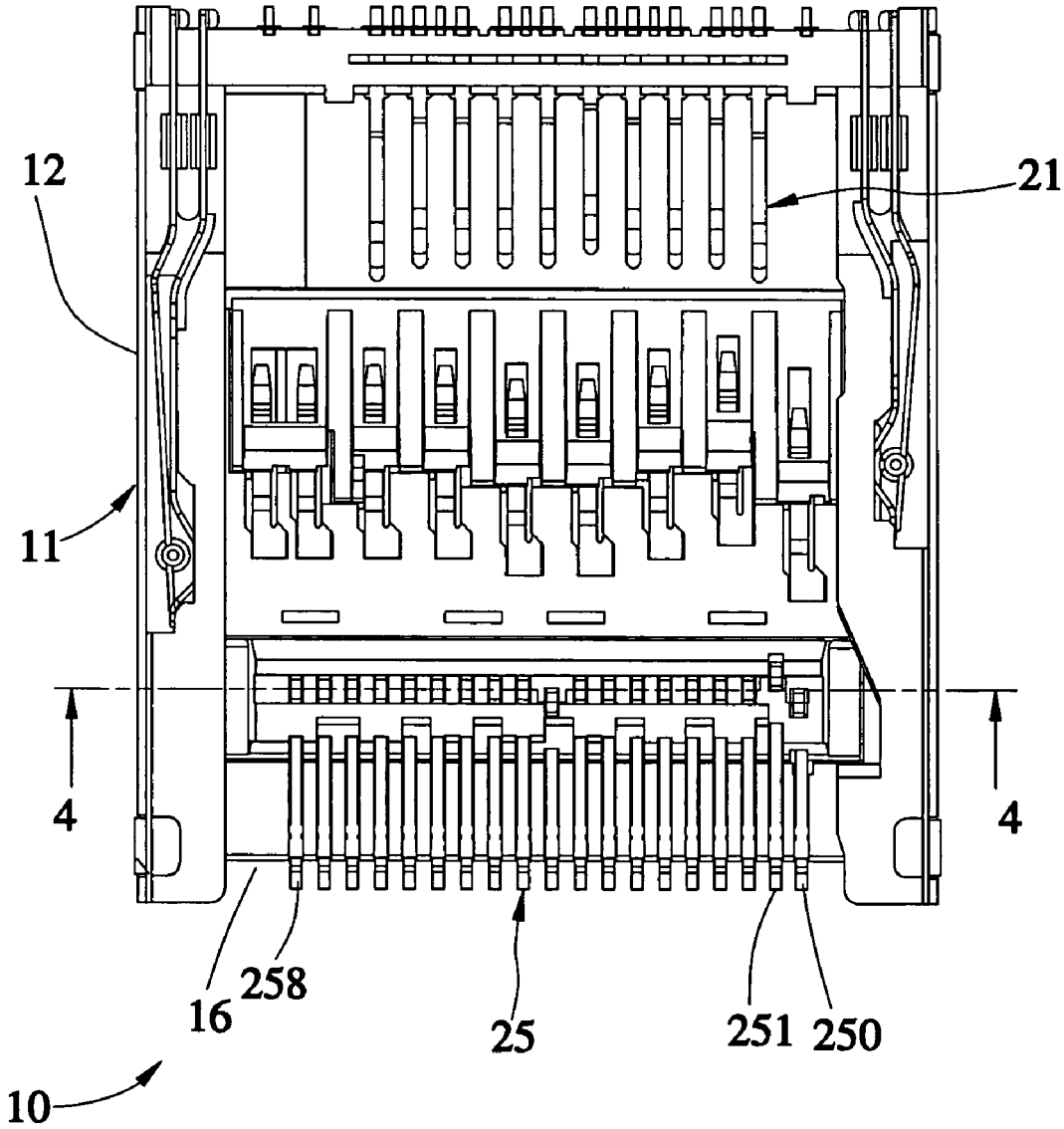
FIG. 3 is a top view of the preferred embodiment of the present invention with the cover removed.

Referring to FIGS. 1–8, a card connector 10 constructed according to a preferred embodiment of the present invention includes a shell 11 and at least two terminal groups 21 and 25.

The shell 11 is composed of a base 12 and a cover 14. An opening 16 is formed at a front end of the shell 11. At least two receiving spaces, two of which are defined as a first receiving space 17 and a second receiving space 18, are formed to extend inwards from the opening 16, partially overlapping each other. The first receiving space 17 is adapted for receiving a first card 91 that is thick and narrow and embodied as an MS card or an MS-DUO adaptor. The second receiving space 18 is adapter for receiving a second card 95 that is thin and wide and embodied as an XD card. The shell 11 includes two first guiding faces 171 formed at bilateral sides of the first receiving space 17 for guiding the first card 91 (MS-DUO adaptor), and two second guiding faces 181 formed at bilateral sides of the second receiving space 18 for guiding the second card 95 (XD card).

Although there are three terminal groups shown in the drawings, it is enough for clarifying the present invention by only two terminal groups 21 and 25 taken as an example. Each of the two terminal groups 21 and 25 includes a plurality of terminals, mounted to the base 12, wherein the first terminal group 21 is located farther from the opening 16 for electronic connection with the first card 91, and the second terminal group 25 is located closer to the opening 16 for electronic connection with the second card 95.

The second terminal group 25 has nineteen terminals numbered 0–18 respectively, wherein No. 0 terminal 250 is a grounded terminal and located at the right side of the second terminal group 25 according to the direction that the card is inserted, No. 1 terminal 251 is a ground terminal and abuts the left side of the No. 0 terminal 250, and No. 18 terminal 258 is a power terminal and located at the left side of the second terminal group 25 according to the direction.

The first card 91 has two electrically conductive surfaces 92 formed at bilateral sides of a bottom side thereof and made of metal.

Figure 4:
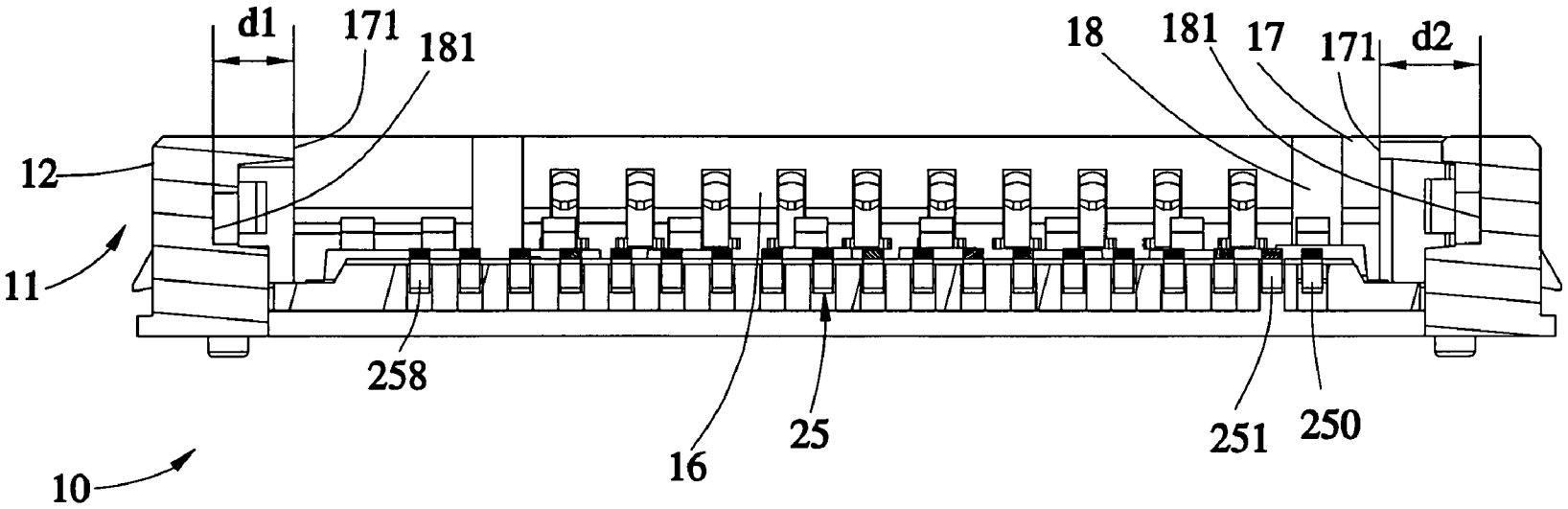
FIG. 4 is a sectional view taken from a line 4—4 indicated in FIG. 3.

Referring to FIG. 4, a first interval d1 is defined between the first and second guiding faces 171 and 181 located close to the No. 18 terminal 258 (power terminal). A second interval d2 is defined between the first and second guiding faces 171 and 181 located close to the No. 0 terminal 250 (sounded terminal). The first interval d1 is smaller than the second interval d2 to enable the first card 91, while inserted, to be inclined more left than the prior art, such that the electrically conductive surface 92 located at one side of the first card 91 does not touch the No. 18 terminal 258 to avoid a short circuit.

Figure 5:
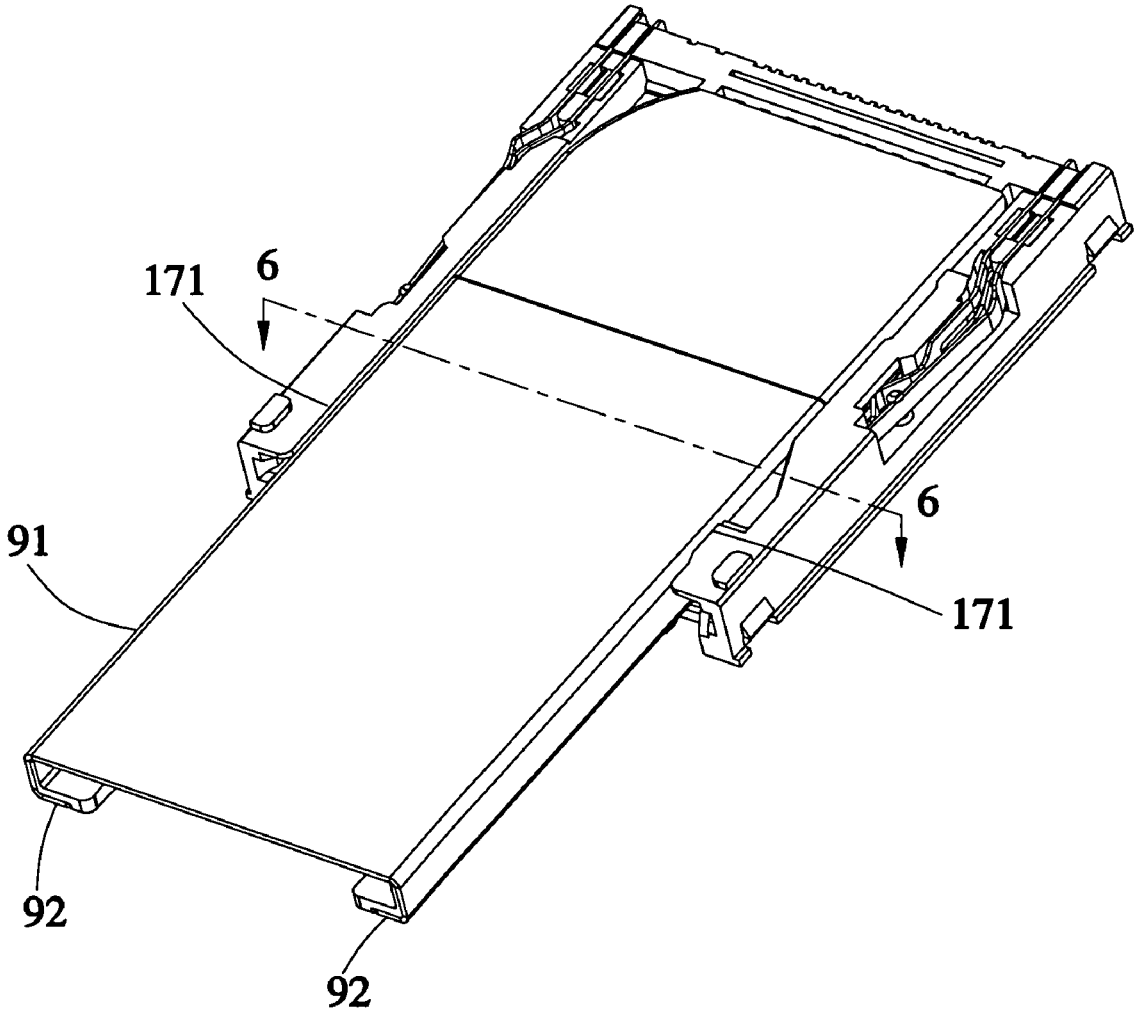
FIG. 5 is a schematic view of the preferred embodiment of the present invention at work, showing that an MS-DUO adaptor is being inserted into the card connector.
Figure 6:
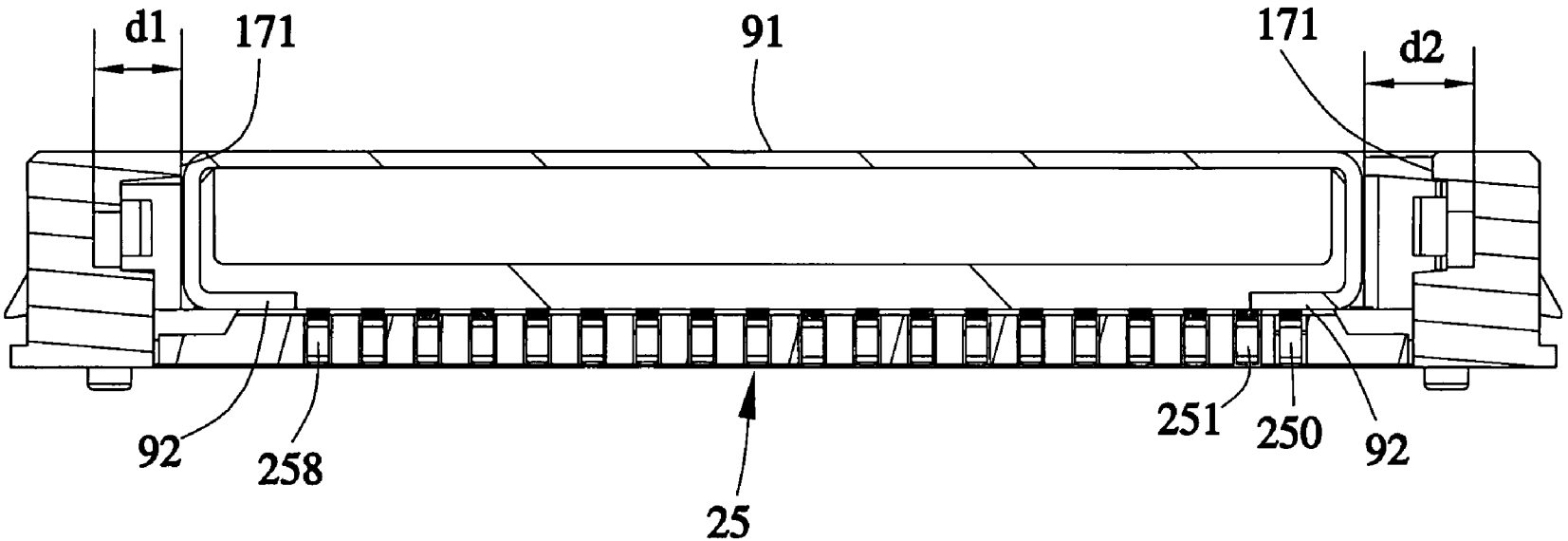
FIG. 6 is a sectional view taken from a line 6—6 indicated in FIG. 5.

Referring to FIGS. 5 and 6, while the first card 91 (MS-DUO adaptor) is inserted, the first card 91 is guided by the first guiding faces 171 to enter the first receiving space 17. In the meantime, as shown in FIG. 6, because the first interval d1 is smaller than the second interval d2, the first card 91 is inserted leftward inward and the electrically conductive surface 92 located at the left side of the first card 91 does not touch the No. 18 terminal 258 while the electrically conductive surface 92 located at the right side of the first card 91 touches Nos. 0 and 1 terminals 250 and 251. It is to be noted that Nos. 0 and 1 terminals 250 and 251 are grounded to incur no short circuit while touching the electrically conductive surface 92. Thus, the present invention securely avoids short circuit incurred by the electrically conductive surfaces 92 of the first card 91 touching the Nos. 0 and 18 terminals 250 and 258.

Figure 7:
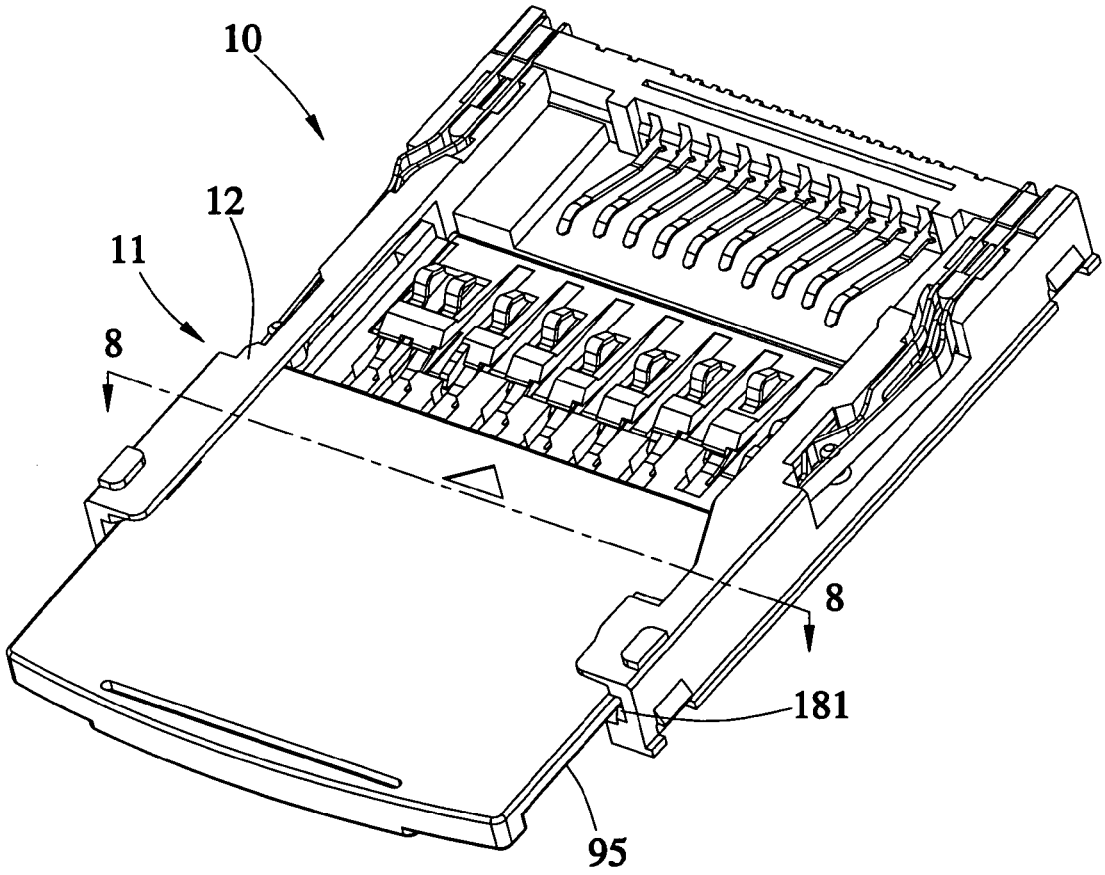
FIG. 7 is a schematic view of the preferred embodiment of the present invention at work, showing that an XD card is being inserted into the card connector.
Figure 8:
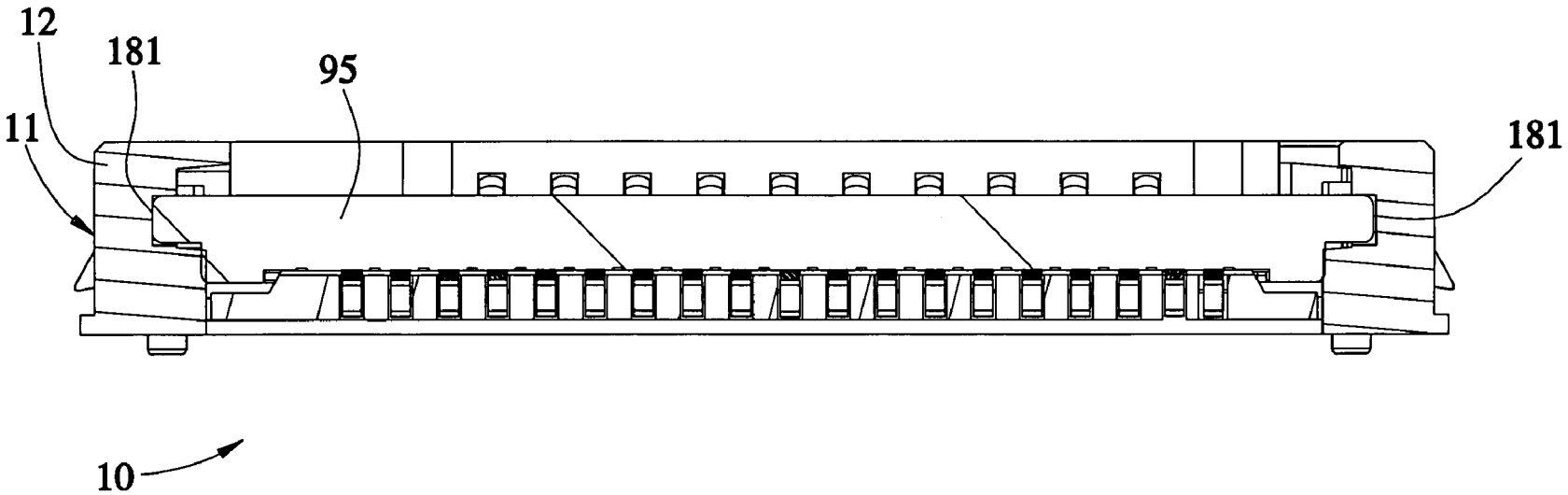
FIG. 8 is a sectional view taken from a line 8—8 indicated in FIG. 7.
Figure 9:
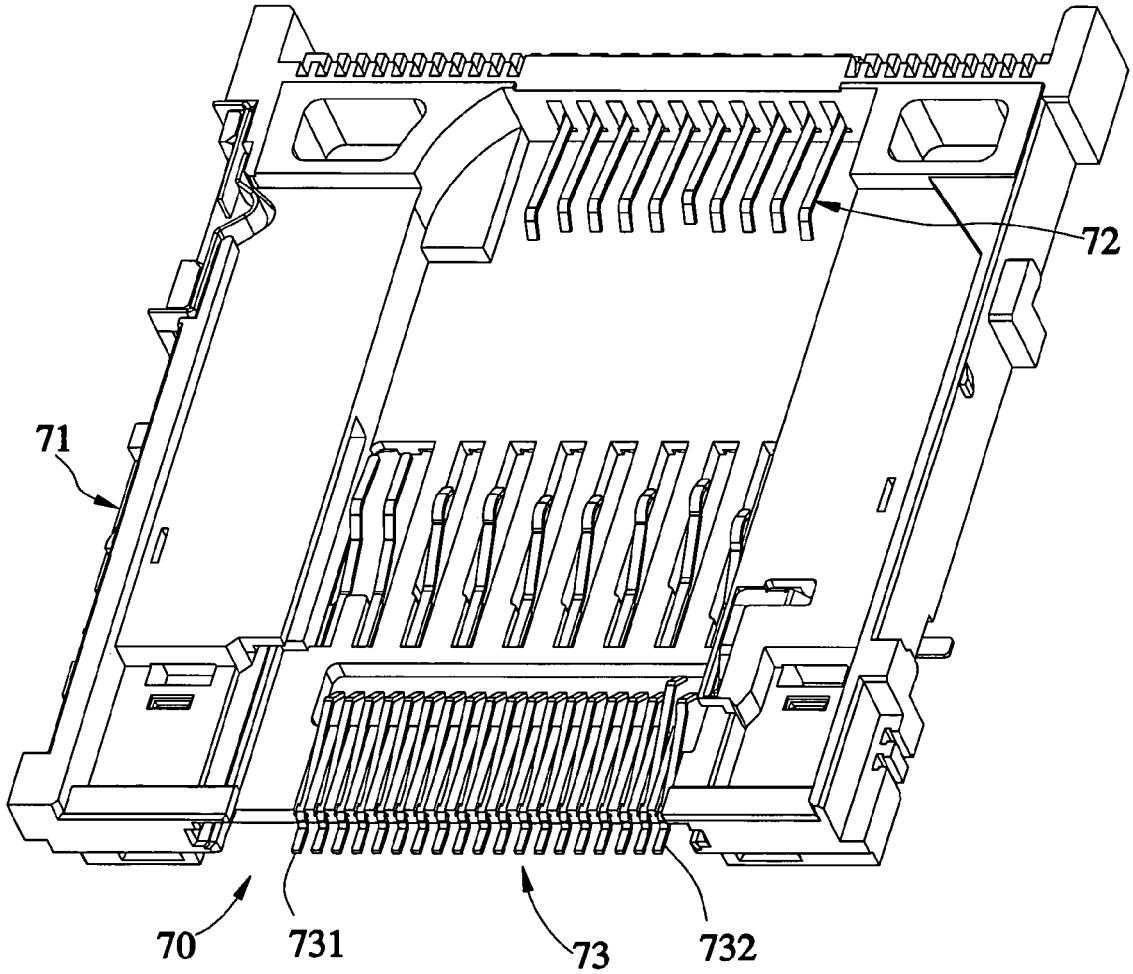
FIG. 9 PRIOR ART
FIG. 9 is a schematic view of a conventional card connector.
Figure 10:
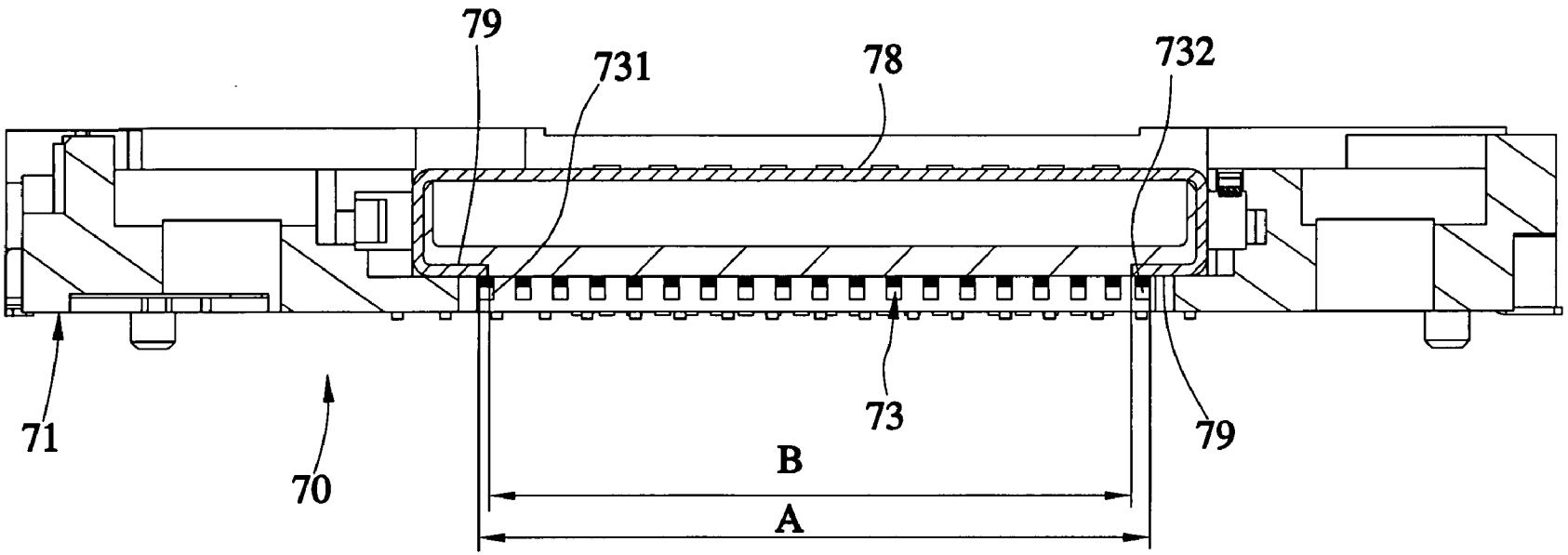
FIG. 10 PRIOR ART
FIG. 10 is a sectional view of the conventional card connector.

Referring to FIGS. 7 and 8, since the operation of the second card 95 is the same as the above, no further recitation is necessary.

As indicated above, the present invention includes the following advantages. The first interval d1 is smaller than the second interval d2 to enable the first card 91 to be inclined left while inserted to further enable the electrically conductive surface 92 to be inclined left, thus preventing the electrically conductive surface 92 from short circuit resulted from touching the No. 18 terminal 258.

What is claimed is:

1. A short-circuit-proof card connector comprising:

a shell including a base and a cover, and having an opening formed at a front end of the shell, at least two receiving spaces extending inward from said opening and partially overlapping each other, two of said at least two receiving spaces being defined as a first receiving space and a second receiving space for receiving a thick and narrow first card and a thin and wide second card respectively, said shell having two first guiding faces and two second guiding faces, said two first guiding faces being formed at bilateral sides of said first receiving space for guiding said first card, said two second guiding faces being formed at bilateral sides of said second receiving space for guiding said second card; and at least two terminal groups each having a plurality of terminals and mounted in said shell to said base, two of said at least two terminal groups being defined as a first terminal group and a second terminal group, said first terminal group being farther from said opening for electronic connection with said first card, said second terminal group being closer to said opening for electronic connection with said second card; wherein said second terminal group having a power terminal and a grounded terminal, a first interval being defined between said first and second guiding faces located close to said power terminal, a second interval being defined between said first and second guiding faces located close to said grounded terminal, said first interval being smaller than said second interval, wherein said thick and narrow first card is a memory stick duo (MS-DUO) adaptor having a conductive surface and said thin and wide second card is an extreme digital (XD) card, said smaller first interval preventing said conductive surface of the MS-DUO adapter from contacting said power terminal of the second terminal group and causing a short circuit.

2. The card connector as defined in claim 1, wherein said second terminal group includes nineteen terminals numbered 0–18 respectively, No. 0 terminal being a grounded terminal, No. 18 terminal being a power terminal.

3. The card connector as defined in claim 2, wherein said power terminal is located at the left side of a direction that a card is inserted into the card connector, and said grounded terminal is located at the right side of the direction.

* * * * *